United States Patent [19]

Røed

[11] Patent Number: 4,469,281

[45] Date of Patent: Sep. 4, 1984

[54] METHOD AND APPARATUS FOR DISINTEGRATION OF SOLIDIFIED BATH MATERIAL ON THE RESIDUES OF PREBAKED ANODES FROM ALUMINIUM ELECTROLYSIS CELLS

[75] Inventor: Finn Røed, Håvik, Norway

[73] Assignee: Norsk Hydro a.s., Oslo, Norway

[21] Appl. No.: 418,170

[22] Filed: Sep. 14, 1982

[30] Foreign Application Priority Data

Oct. 6, 1981 [NO] Norway ..... 813376

[51] Int. Cl.[3] ..... B02C 19/00

[52] U.S. Cl. ..... 241/1; 29/426.4; 204/67; 241/301

[58] Field of Search ..... 204/67, 243 R, 245; 225/103; 164/158; 29/426.4; 15/300 R; 241/1, 277, 301

[56] References Cited

U.S. PATENT DOCUMENTS

| | | | |
|---|---|---|---|
| 3,770,212 | 11/1973 | Kassir et al. | 241/1 |
| 4,043,019 | 8/1977 | Schroder | 29/426.4 |
| 4,119,505 | 10/1978 | Baillot et al. | 204/67 |
| 4,169,299 | 10/1979 | Bandoh | 164/158 |

*Primary Examiner*—Howard S. Williams

*Attorney, Agent, or Firm*—Wenderoth, Lind & Ponack

[57] ABSTRACT

The disintegration of solidified bath material on the residues of prebaked anodes is achieved by partially removing the bath material from the anode surface by core drilling which simultaneously initiates disintegration of the remaining bath layer. One or more core drills are moved parallel to the anode surface between steel nipples of the anode rod for disintegration of the bath layers.

8 Claims, 4 Drawing Figures

METHOD AND APPARATUS FOR DISINTEGRATION OF SOLIDIFIED BATH MATERIAL ON THE RESIDUES OF PREBAKED ANODES FROM ALUMINIUM ELECTROLYSIS CELLS

BACKGROUND OF THE INVENTION

This invention relates to a method for the disintegration and removal of solidified bath material on the residues of prebaked anodes from aluminum electrolysis cells and to an apparatus for carrying out the method.

A prebaked anode consists of a calcinated carbon block provided with holes in the top where an aluminum/steel current-providing rod is fastened either by means of cast iron or a so-called rodding-mix. The anode rod consists of from two to six vertical cylindrical steel nipples connected together by a top steel cross bar which is connected to a vertical aluminum rod.

The carbon block is consumed in the electrolysis cell and the anode has to be removed when the height of the block is reduced to approximately 20%. The top of the carbon block is then covered by a thick layer of solidified bath which sticks to the above mentioned nipples between the carbon block and the steel crossbar. The bath crust can be very hard and consists of a solidified mixture of cryolith and aluminum fluorid with some alumina.

Both the bath material and the carbon residue have to be recovered separately for recycling in the electrolysis process.

The conventional method of breaking down this crust layer is by means of manually operated large pneumatic chisel machines (hammers). This is hard work, where the chisel is partly used as a crowbar.

Furthermore, this method involves considerable environment problems in the form of noise and dust formation even if mechanized as discloed in U.S. Pat. No. 4,119,505 describing an apparatus comprising a pneumatic drill equipped with a precussion tool. Relatively large loads are applied and represent a danger of deformation of the anode rod construction which leads to damaged weld connection between the Al-rod and the steel cross bar. Furthermore, break-up of the anode residue occurs simultaneously, so that it is necessary to separate bath and carbon bits from each other.

Known mechanized equipment, based upon the use of hydraulic pressure power provide, a complicated disintegration operation. The steel nipples themselves are in this case applied as a dolly and must therefore frequently be manually released from the bath in the first place. Besides the above mentioned drawbacks, —deformation of the anode rod assembly and simultaneous breaking of anode residues, poor regularity and low reliability of service are also characteristic for prototypes of mechanized equipment which thus far have been developed and tested.

SUMMARY OF THE INVENTION

It is therefore an object of the present invention to provide a new method and an apparatus to carry out this method, which ensure a mechanized and lenient disintegration of the solidified bath material and at the same time a superior capacity and high reliability of the equipment service.

Another object of the invention is to provide a method and an apparatus satisfying the strict requirements with regard to noise and dust allowed in work shops.

These objects according to the invention are achieved by partial removal of the bath material from the anode surface by core drilling with simultaneously initiated disintegration of the remaining bath layer.

During drilling trials it has surprisingly been found that by choosing an optimal ratio between the number of revolutions and the thrust exercised by the drills the following effects are achieved:

1. Vibration-free drilling even in thin bath discs (layers).
2. Sufficient disintegration of adjacent material at low loads.
3. Operation speed/capacity which is twice as high as that required from an integrated installation for cleaning/removing of anode residues.

BRIEF DESCRIPTION OF THE DRAWINGS

These and other characteristic features of the invention will be more apparent from the following description, taken with the accompanying drawings, where FIGS. 1(*a*) and 1(*b*) respectively are an elevation view and a section through line I—I of FIG. 1(*a*) showing the apparatus of the invention, and FIGS. 2(*a*) and 2(*b*) are sections respectively showing without, and with a mandrel or a push bar to retain the drilled monoliths of the bath crust on the anode after drilling.

DETAILED DESCRIPTION OF THE INVENTION

Figure 1A:
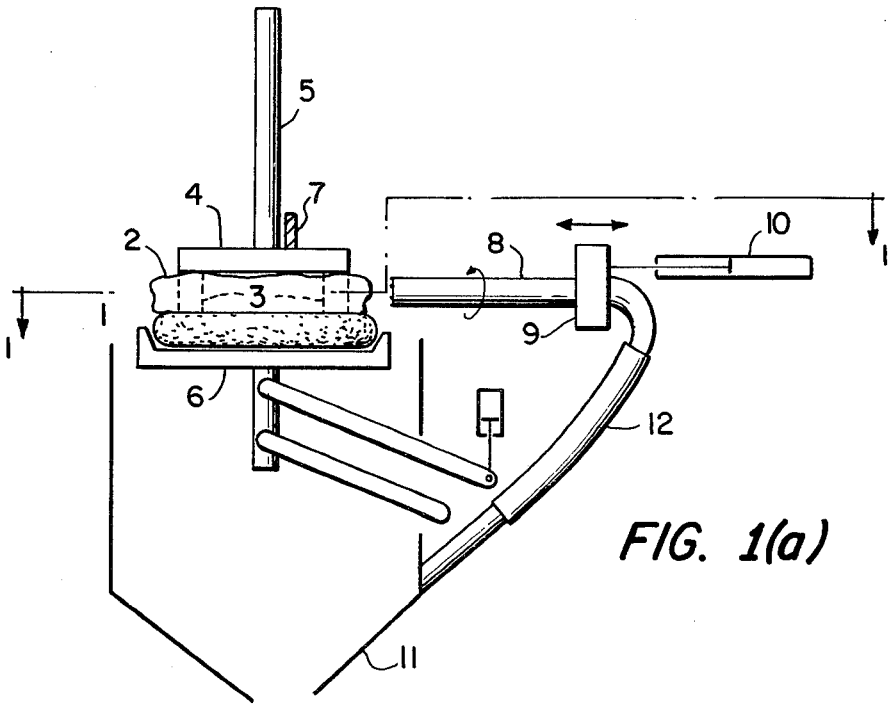
Figure 1:
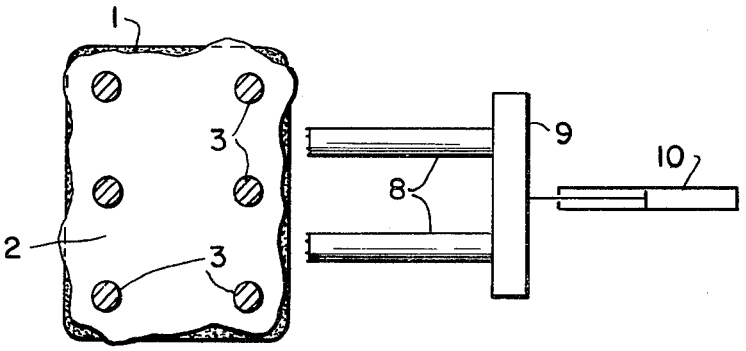

FIG. 1(*a*) shows in principle a machine which can be integrated in a suspended transport system normally used for transport of anodes in an anode assembling shop (not shown). A spent anode block or residue (1) with a solidified bath layer (2) around steel nipples (3) with a steel cross bar (4) welded to an Al-rod (5) is conveyed to an operative position by means of a lifting table (6). The anode is fastened prior to the drilling operation, e.g. to a fixed installed beam (7).

A horizontally movable drill device, comprising one or more parallel core drills (8) with a joint powering mechanism (9), is brought to the bath layer (2), and the drills (8) cut through the bath layer under the load from a pressure cylinder (10).

The drills have an outer diameter approximately identical to the distance between the anode residue (1) and the steel cross bar (4), and further are hollow over their whole length in order to remove the out-drilled material.

The bath material is further conveyed by means of a hose or flexible tube (12) to a collecting hopper (11) located under the fastened anode.

FIG. 1(*b*) is a horizontal cross-section through the anode and drilling device along the line I—I in FIG. 1(*a*). The Figure shows the anode residue (1) with six steel nipples (3) covered by the solidified bath (2). Two parallel core drills (8), in this case connected to the same powering unit (9), are at the starting point for drilling-/disintegration of the bath layer (2) between the steel nipples (3) on the leveled, fastened anode residue (1).

Figure 2A:
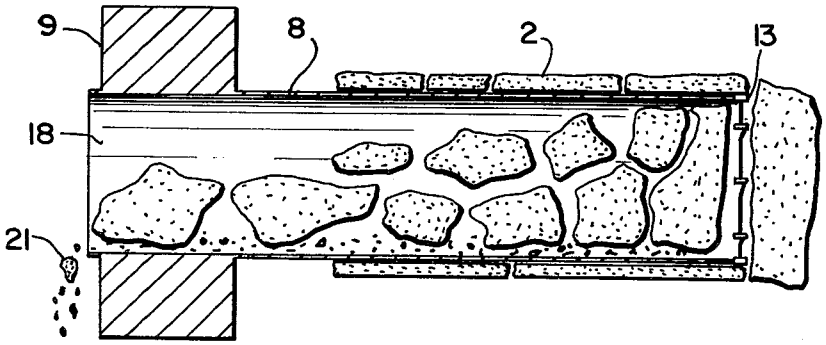
Figure 2B:
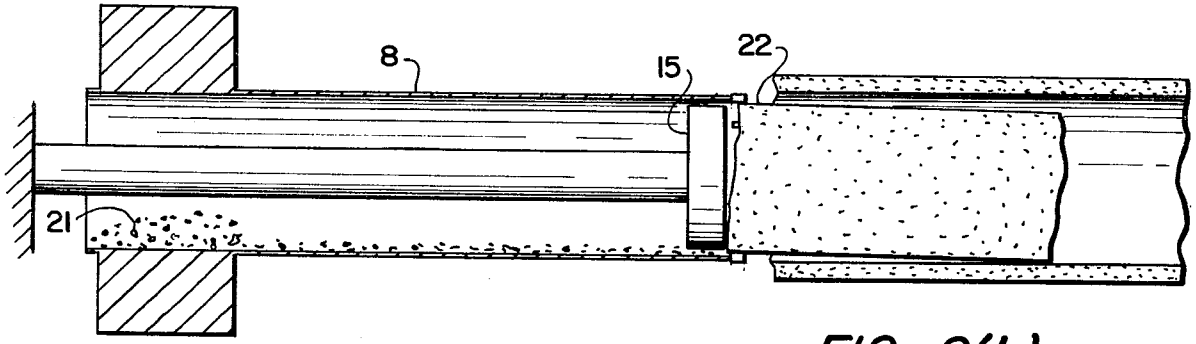

FIG. 2(*a*) shows in detail the core drill (8) with the powering mechanism (9) and cutting tools (13) during the drilling in bath layer (2). The bath core, which is pressed through the core drill under successive drilling, consists of dust and smaller lumps (21) which are continuously conveyed out through a central aperture (18)

running continuously along the whole length of the core drill.

It can be advantageous to retain the big cylindrical lumps (22) which are periodically formed during drilling.

FIG. 2(*b*) shows a modified embodiment of the drilling device provided with a push bar (15) which ensures that the monolithic bath cores (22) remain on the anode surface after the drill (8) is withdrawn. Only the fine material (21) passes by the push bar through the drill, and an automatic rough classification of the bath material is achieved.

EXAMPLE

Ten anode residues with variable thickness of the solidified bath layer (from 50 to 200 mm) were subjected to practical tests with the present drilling means. A core drill with a diameter of 150 mm penetrated the bath layers (drilling distance approximately 1000 mm) during 10 to 30 secs., at 400–600 revs./min. The disintegrated bath material, which remained on the anode residues after drilling, was easily removed without the use of any kind of pneumatic powered tools. Noise and dust formation during drilling were minimal. The tests have shown that the drilling in this hard and unhomogeneous material could be conducted without noticeable vibrations, even if only a part of the drill's periphery was cutting in a thin, flake-formed bath material on the anode surface or under the steel cross bar. This is possible because of the relatively low load (feeding speed) applied to the drills which is sufficient to achieve the aimed bursting effect on the adjacent bath material. This disintegration of the bath layer is still superior with regard to capacity in comparison with the removal methods which presently are known and applied in practice.

The drilling device as described above and shown in FIGS. 1(*a*)–2(*b*) represents only one practical embodiment according to the invention. Other constructions and modifications of the illustrated drilling device can be employed within the scope of the present invention, e.g. the drilling can take place in a vertical direction on anodes where the transport system and the anode assembling layout make it possible. The disintegrated bath material and the bath cores as well will then automatically be released and fall down from the anode residues.

The continuous removal of dust and fine particles during drilling can also be done by means of one or more radially arranged apertures in the core driller's body.

I claim:

1. A method for the disintegration of solidified bath layers on the residues of prebaked anodes from aluminum electrolysis cells, wherein the prebaked anodes each comprise a calcinated carbon block connected to a current-providing rod through one or more cylindrical steel nipples, said method comprising partially removing the bath material from the surface of the anode by core drilling portions of said bath material and simultaneously initiating disintegration of the remaining bath material of the bath layer.

2. A method as claimed in claim 1, wherein the bath layers are disintegrated by means of one or more core drills which are moved parallel to the anode surface.

3. A method as claimed in claim 2, wherein one or more holes are drilled through the bath layer between the steel nipples of the anode rod.

4. A method as claimed in claim 2, wherein each said core drill has a central aperture, and further comprising continuously conveying out through said central aperture cored bath material drilled by said core drill.

5. An apparatus for the disintegration of solidified bath layers on the residues of prebaked anodes from aluminum electrolysis cells, wherein the prebaked anodes each comprise a calcinated carbon block connected to a current-providing rod through one or more cylindrical steel nipples, said apparatus comprising:

means for lifting and lowering an anode to and from a disintegrating position;

means for fastening said anode at said position; and means for partially removing the bath material from the surface of the anode by core drilling portions of the bath material and simultaneously initiating disintegration of the remaining bath material of the bath layer, said removing means comprising a drilling device including at least one core drill for core drilling the bath material when the anode is fastened at said position.

6. An apparatus as claimed in claim 5, wherein each said core drill has a central aperture and is hollow along the entire length thereof.

7. An apparatus as claimed in claim 6, wherein each anode further includes a steel cross bar fixed to the currentproviding rod, and each said core drill has a diameter approximately identical to the distance between the steel cross bar and the anode surface, and further comprising a powering unit connected to said core drills, said central aperture of each said core drill extending through said powering unit.

8. An apparatus as claimed in claim 6, further comprising a push bar extending through said central aperture in each said core drill for maintaining on the surface of anode a substantially unitary core of the bath material drilled by said core drill.

* * * * *